US008146527B2

(12) United States Patent
Pellen

(10) Patent No.: US 8,146,527 B2
(45) Date of Patent: Apr. 3, 2012

(54) OFFBOARD CONNECTION SYSTEM

(75) Inventor: Alain T. Pellen, Boca Raton, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 241 days.

(21) Appl. No.: 12/564,352

(22) Filed: Sep. 22, 2009

(65) Prior Publication Data

US 2011/0067619 A1 Mar. 24, 2011

(51) Int. Cl.
*B63G 8/41* (2006.01)
*B63B 21/58* (2006.01)

(52) U.S. Cl. ..... 114/322; 114/249

(58) Field of Classification Search ..... 114/244, 114/230.2, 243, 249, 251, 253, 322, 51; 439/312, 439/247, 248, 374, 378; 137/615; 141/369, 141/370, 382, 384
See application file for complete search history.

(56) References Cited

U.S. PATENT DOCUMENTS 3,199,553 A * 8/1965 Garrett et al. ..... 141/388
3,536,023 A 10/1970 Bascom et al.
3,987,741 A 10/1976 Tryon
3,993,011 A 11/1976 Garland
4,686,927 A 8/1987 Hawkes et al.
5,995,882 A 11/1999 Patterson et al.
6,148,759 A 11/2000 Taylor, Jr.
6,223,675 B1 5/2001 Watt et al.
6,257,162 B1 7/2001 Watt et al.
6,260,504 B1 7/2001 Moles et al.
6,269,763 B1 8/2001 Woodland
6,273,744 B1 * 8/2001 Murdock et al. ..... 439/374
6,390,012 B1 5/2002 Watt et al.
6,588,359 B1 7/2003 Powers
6,681,711 B2 1/2004 King
6,691,636 B2 2/2004 King
6,698,376 B2 3/2004 Delahousse et al.
6,926,049 B1 * 8/2005 Enig et al. ..... 141/387
7,000,560 B2 2/2006 Wingett et al.
7,028,627 B2 4/2006 Bouchaud et al.
7,156,036 B2 1/2007 Seiple
7,179,145 B2 2/2007 Driscoll et al.
7,857,261 B2 * 12/2010 Tchoryk et al. ..... 244/172.4
2001/0020435 A1 9/2001 Ghignone
2006/0191457 A1 8/2006 Murphy
2007/0051292 A1 3/2007 Kilbourn et al.

* cited by examiner

*Primary Examiner* — Lars A Olson
*Assistant Examiner* — Andrew Polay
(74) *Attorney, Agent, or Firm* — DeMont & Breyer, LLC

(57) ABSTRACT

A system for connecting an auxiliary craft and a mother ship includes a cable suspended from the mother ship, a cable tensioner, a mother-ship coupler that is slideably engaged to the cable, a fixture that depends from the auxiliary craft, and an auxiliary-craft coupler. The auxiliary craft is maneuvered to engage the cable. Once engaged, the cable tensioner tensions the cable, thereby maintaining the auxiliary craft in position next to the mother ship. As the cable is tensioned, the auxiliary-craft coupler axially aligns to the mother-ship coupler. After axial alignment, the mother-ship coupler is released to slide into mating engagement with the auxiliary-craft coupler. Mated couplers enable bi-directional electrical or optical communications as well as the transfer of power, fuel or other fluids from the mother ship to the auxiliary craft.

17 Claims, 14 Drawing Sheets

Figure 3
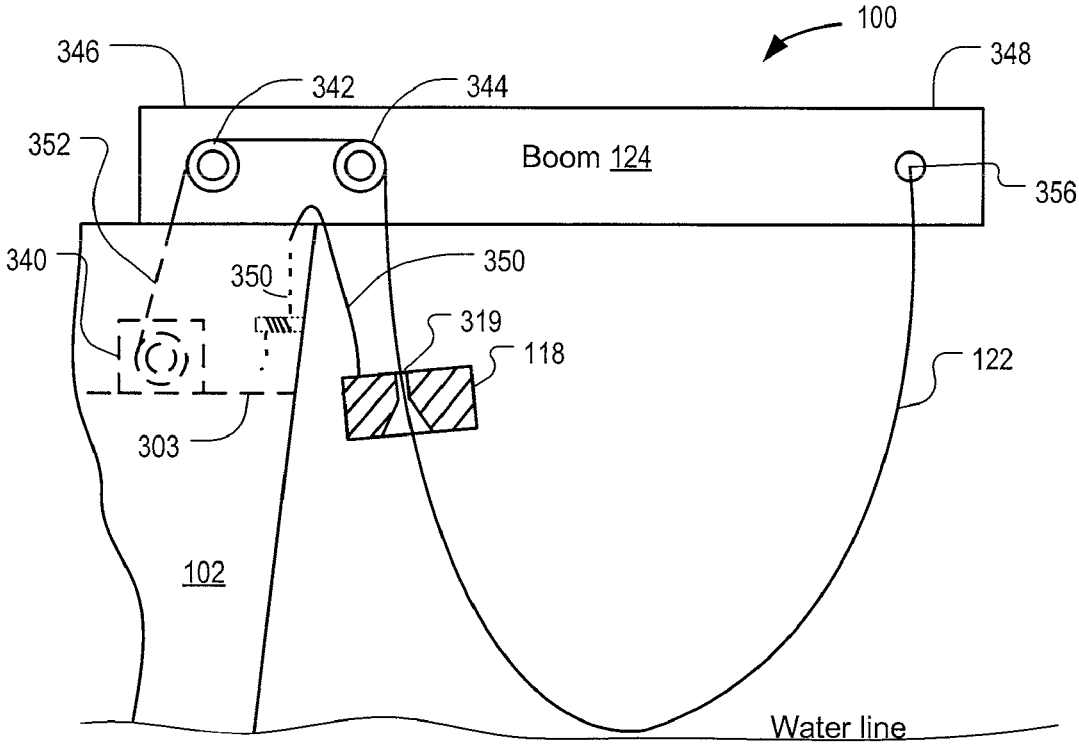
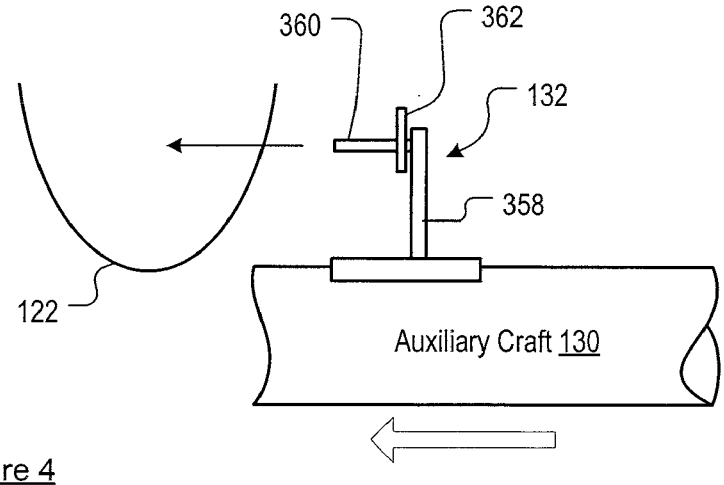
Figure 4

Figure 12
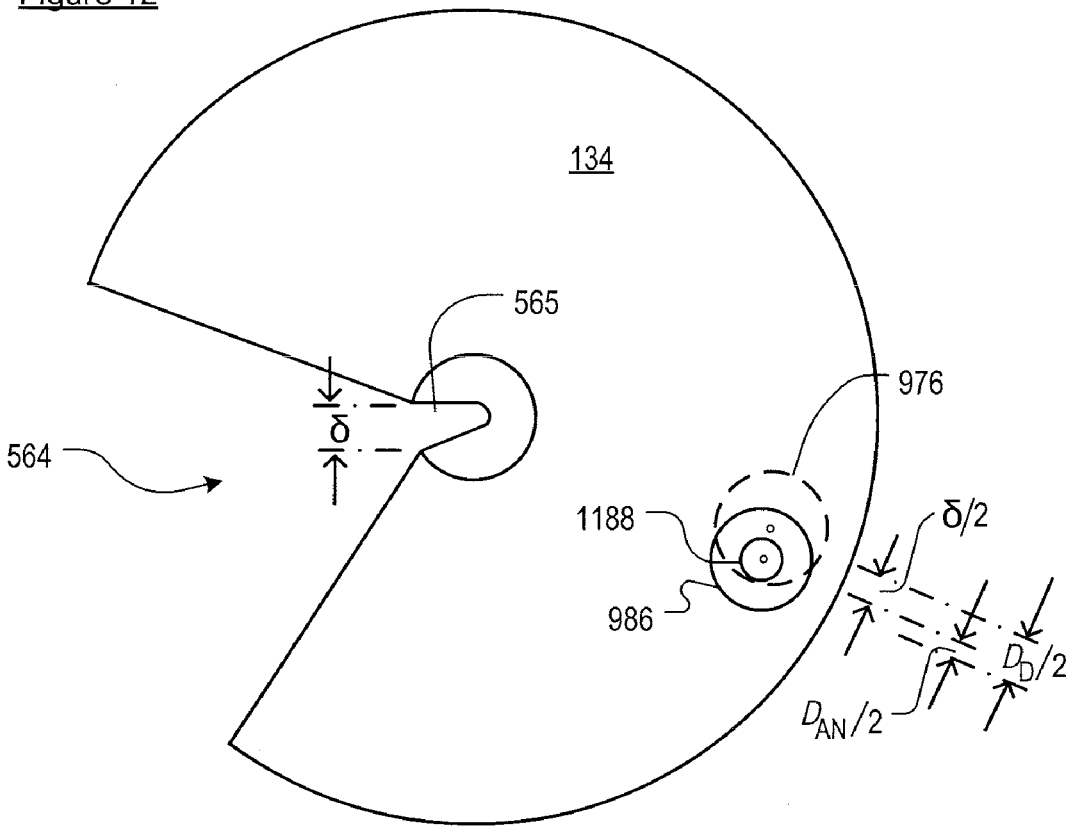
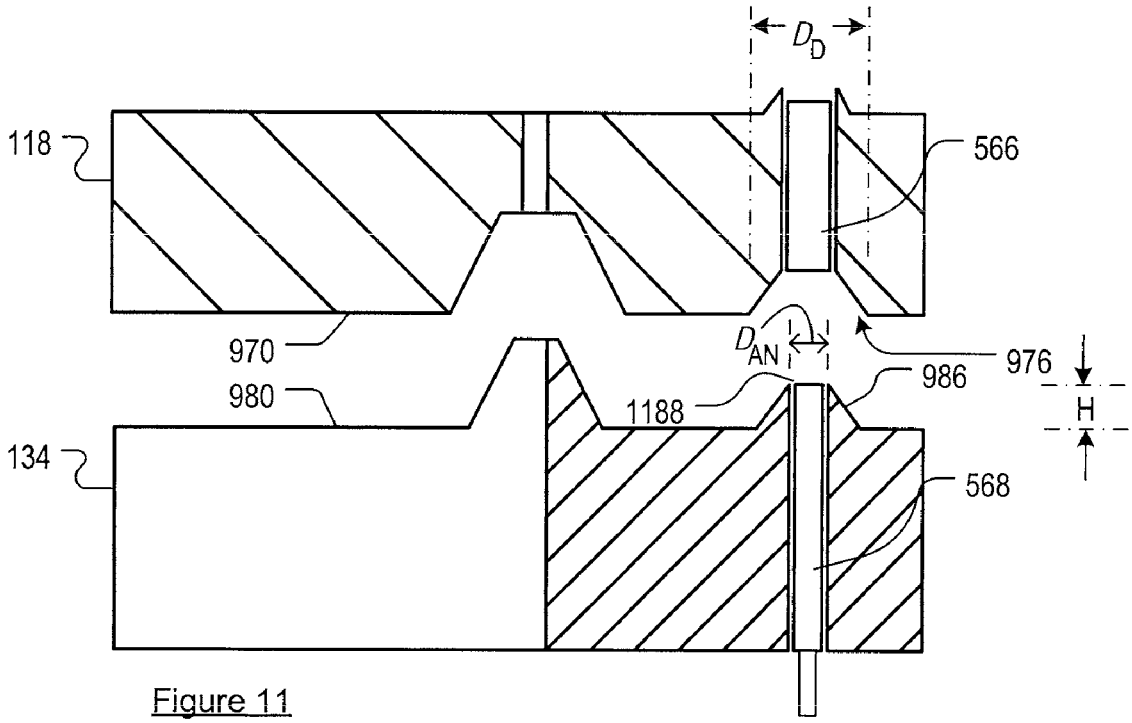
Figure 11

OFFBOARD CONNECTION SYSTEM

FIELD OF THE INVENTION

The present invention relates generally to the field of maritime equipment and more particularly to a system for connecting a mother ship and an auxiliary craft.

BACKGROUND OF THE INVENTION

Autonomous underwater vehicles ("AUVs") are used in both naval and industrial applications. Due to their limited operating range, they require regular servicing to recharge batteries, refuel, etc. It is often desirable to perform this servicing at sea from a mother ship.

Recharging or refueling operations require the engagement of various connectors to couple various wires or hoses. Conducting these operations at sea requires that the mother ship and the auxiliary craft (e.g., AUV, etc.) be stabilized with respect to one another. These operations can be labor intensive and present certain risks, especially if performed in higher sea states.

Existing approaches for connecting an auxiliary craft to a mother ship for service, as disclosed in the following references, have various drawbacks.

US Application No. 20060191457 A1 discloses a marine payload handling craft and system for launching and recovering marine vehicles. The system includes a catamaran docking station, which includes an elevator. The system, which is attached to a larger vessel, receives the smaller vessel as it is driven onto the docking station.

U.S. Pat. No. 6,390,012 B1 discloses an apparatus and method for deploying and servicing an underwater vessel from a larger vessel. The apparatus utilizes a connector latching system that includes a maneuverable and remotely-operated underwater vessel to physically engage a receptor on the autonomous underwater vessel.

U.S. Pat. No. 6,698,376 B2 discloses a device for launching and recovering an underwater vehicle that utilizes a submerged docking station. The docking station includes lower and upper chassis that are connected by flexible cables so that distance between the two chassis can be adjusted. The chassis form a receiving cage to support and hold the underwater vehicle.

U.S. Pat. No. 3,536,023 A discloses a system for handling small submarines. The system utilizes an elevator system that is suspended from a surface ship for lifting the submarine. Counterweights are located below the surface of the water to restrain the motion of the elevator and a hoisting arrangement drives the elevator.

The prior art devices are relatively complex and require significant manual intervention. This results in relatively high costs and potential reliability problems. Simply put, the prior art does not provide an effective servicing solution.

SUMMARY OF THE INVENTION

The present invention provides an offboard connection system for the temporary connection of an auxiliary craft and a mother ship that avoids some of the disadvantages of the prior art.

In the illustrative embodiment, the system comprises a loop of cable suspended from the mother ship, a cable tensioner, a mother-ship coupler, a fixture mounted on the auxiliary craft, and an auxiliary-craft coupler.

In operation, the auxiliary craft is maneuvered so that the fixture engages the loop of cable. Once engaged, the cable tensioner tensions the cable, thereby tethering the auxiliary craft to the mother ship. The mother-ship coupler is arranged to freely slide along the cable. The auxiliary-craft coupler is rotatably attached to the fixture. In some embodiments, this rotatable attachment has at least two degrees of freedom to provide the compliance required for proper alignment between the two couplers. In some embodiments, a ball joint is used to provide multiple degrees of freedom.

By virtue of one or more physical adaptations of the auxiliary-craft coupler, the cable, when tensioned, forces the auxiliary-craft coupler into axial alignment with the mother-ship coupler. In addition to its tethering and axial-alignment functionality, the cable serves as a guide that directs the mother-ship coupler to the auxiliary-craft coupler for mating. In particular, after the couplers are axially aligned, the mother-ship coupler is released to slide downward along the cable, due to gravity, to eventually engage the auxiliary-craft coupler. In the illustrative embodiment, a helicoidal guide disposed on one of the couplers provides end-of-travel rotational alignment.

The mother-ship coupler and the auxiliary-craft coupler include individual mating connectors. When the couplers are mated, the connectors enable the transmission of signals (e.g., electrical, optical, etc.), power (e.g., electrical, etc.), and fluids (e.g., liquid fuel, water, gas, etc.) between the mother ship and the auxiliary craft.

In some embodiments, the system comprises:

- a first coupler associated with a mother ship, wherein the first coupler is slideably mounted to a cable that depends from the mother ship;
- a second coupler associated with an auxiliary craft; and
- an alignment mechanism for axially aligning the first coupler and the second coupler, wherein the alignment mechanism comprises the cable and a cable tensioner that is connected to the cable.

BRIEF DESCRIPTION OF THE DRAWINGS

FIG. 3 depicts an embodiment of the cable tensioner of the system of FIG. 1A, wherein the system is in a quiescent state.

FIG. 4 depicts a fragmentary view of the auxiliary craft, illustrating the manner in which the craft snags the loop of cable.

FIG. 11 depicts a simplified sectional view of fine rotational-alignment features for use in conjunction with the illustrative embodiment of the present invention.

FIG. 12 depicts the manner in which the fine rotational-alignment features shown in FIG. 11 accommodate misalignment that results from the coarse rotational-alignment features of FIG. 10.

DETAILED DESCRIPTION

Figure 1A:
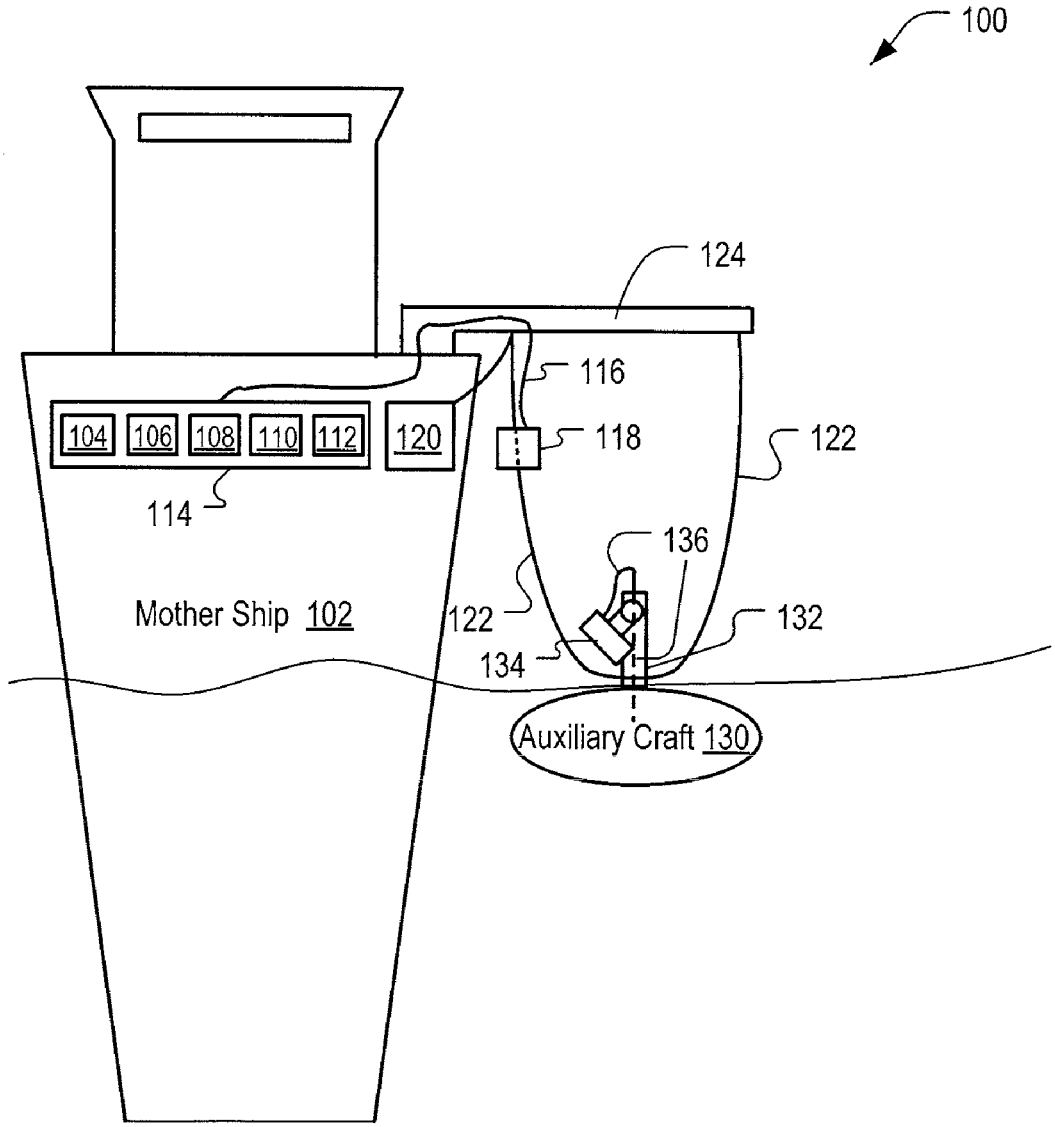
FIG. 1A depicts a simplified overall schematic view of an offboard connection system in accordance with the illustrative embodiment of the present invention. The system is depicted in a quiescent state as an auxiliary craft approaches the mother ship.
Figure 1B:
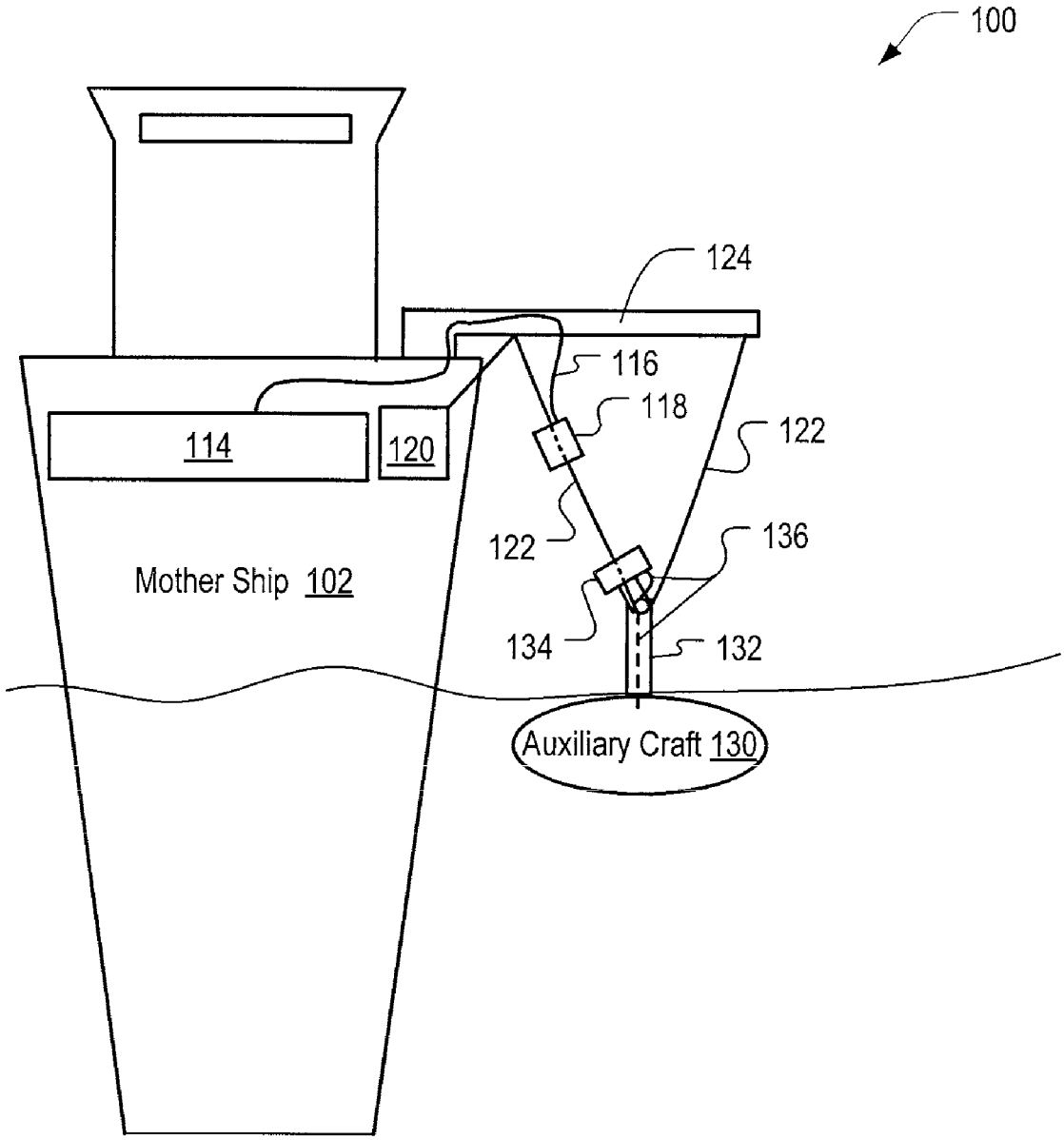
FIG. 1B depicts the system of FIG. 1A after the mother ship and auxiliary craft are tethered to one another.
Figure 1C:
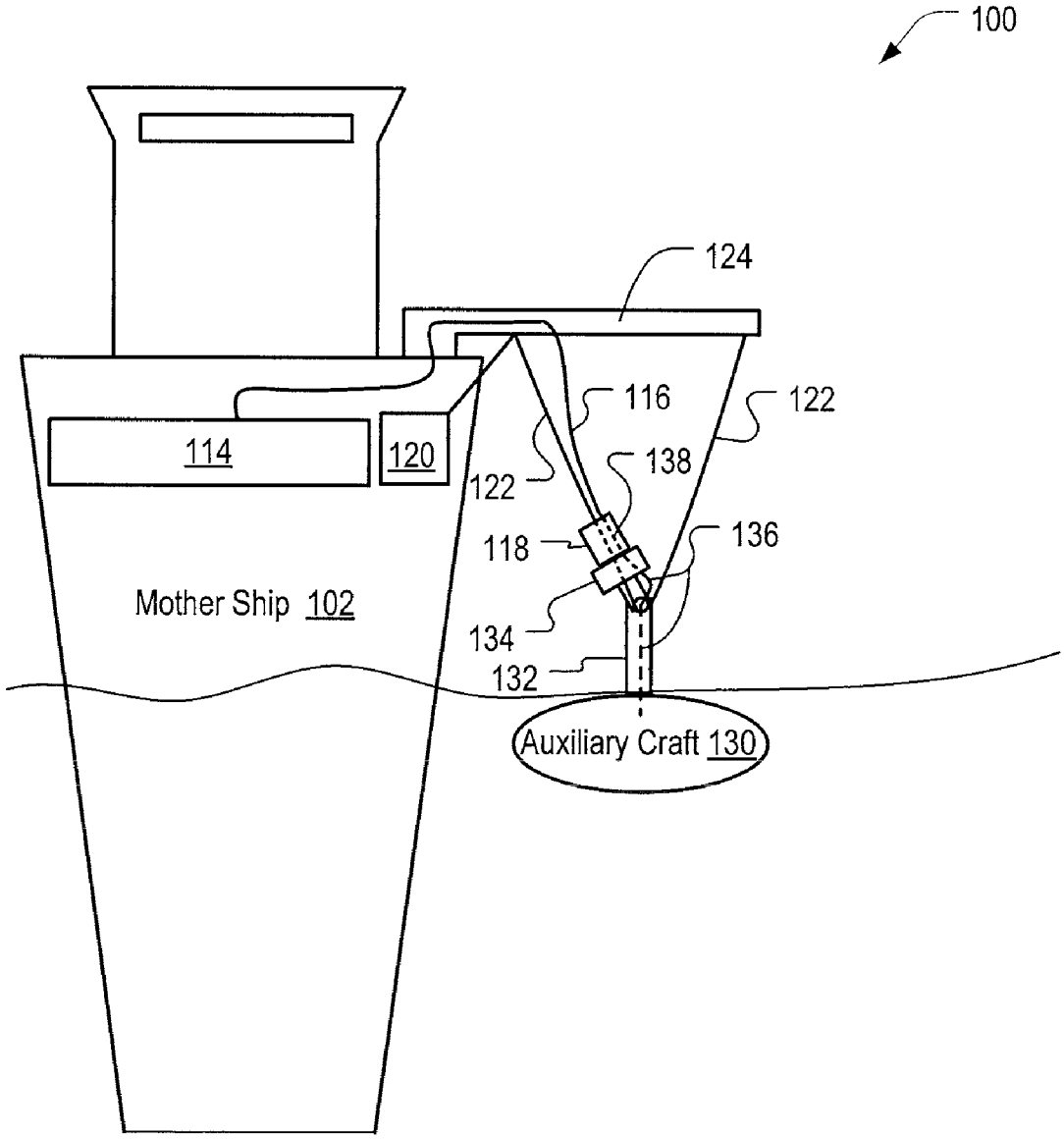
FIG. 1C depicts the system of FIGS. 1A and 1B after the mother ship and the auxiliary craft are in fluidic, electrical, and/or optical communication with one another.

FIGS. 1A through 1C provide an overview of the structure and operation of offboard connection system 100 in accordance with the illustrative embodiment of the present invention. The system creates a temporary connection that enables fluids, signals, and power to be transferred between mother ship 102 and auxiliary craft 130. In some embodiments, auxiliary craft 130 is an autonomous underwater vehicle ("AUV"), but can suitably be any relatively small (i.e., smaller than the mother ship) surface or submersible ship.

FIG. 1A depicts system 100 in a quiescent state, before any connection has been made between mother ship 102 and auxiliary craft 130. FIG. 1B depicts system 100 in an actuated state wherein the mother ship and the auxiliary craft are tethered to one another but before fluidic, signal, and/or power-transferring connection has been established. FIG. 1C depicts full fluidic, signal, and/or power-transferring connection between mother ship 102 and auxiliary craft 130.

Referring now to FIG. 1A, the salient features of system 100 include: mother-ship coupler 118, cable tensioner 120, cable 122, auxiliary-craft fixture 132, and auxiliary-craft coupler 134.

Boom 124, which depends from mother ship 102, suspends cable 122 over the water in the form of a loop (when the system is in the quiescent state). The boom can be fixed or rotatable/extendable. A sufficient length of cable 122 is used so that the bottom of the loop is near to the water line. As discussed further below in conjunction with FIG. 1B, the loop of cable is intended to be snagged by fixture 132 of auxiliary craft 130.

Cable tensioner 120 is disposed on mother ship 102. As discussed later in conjunction with FIGS. 1B, 1C, and 5-7, cable tensioner 120 applies tension to cable 122 under certain conditions.

Mother-ship coupler 118 is slideably engaged to cable 122. Coupler 118 receives any one or more of the following supplies from sources thereof on board mother ship 102:

liquid fuel from liquid-fuel source 104;

other fluids (e.g., water, gases, etc.) from sources 106 thereof;

electrical signal(s) (e.g., data, control signals, etc.) from electrical-signal source(s) 108;

electrical power from electrical-power source 110; and optical signal(s) from optical-signal source 112.

The phrase "utilities and signals" 114 will hereinafter be used in this description as well as the appended claims to refer to any one or more of the various fluids, power, and signals referenced above. Utilities and signals 114 are conducted to coupler 118 via appropriate hose(s), electrical cable(s), and optical cable(s), which are collectively referenced "conduit 116." As used herein, references to "conduit," unless otherwise specified, are intended to refer to any one or more of hoses, electrical cable, and/or optical cable, as is appropriate for the context.

FIG. 1A depicts auxiliary craft 130 near to the water line in the vicinity of mother ship 102. Depending from the top of auxiliary craft 130 is fixture 132. The fixture has a structural arrangement that is suitable for snagging the loop of cable 122. For example, fixture 132 can be in the form of a "hook," etc.

Auxiliary-craft coupler 134 is rotatably coupled to fixture 132. Coupler 134 is structurally arranged and suitably dimensioned to mate to mother-ship coupler 118. Auxiliary-craft coupler 134 is in fluidic-, signal-, and/or power-transferring communication with auxiliary craft 130 via "conduit" 136. Like conduit 116, conduit 136 is actually one or more hose(s), electrical cable(s), optical cable(s) and the like as appropriate for transferring utilities and signals 114 from the coupler 134 to auxiliary craft 130.

Referring now to FIG. 1B, auxiliary craft 130 is maneuvered so that fixture 132 snags the loop of cable 122. Once this occurs, cable tensioner 120 is activated to take up all slack on cable 122. The cable tensioner can be arranged to activate automatically when it senses tension in cable 122 as caused by the snag. In some alternative embodiments, cable tensioner 120 can be activated manually. It will be appreciated that cable 122 must be suitable for withstanding the tension required for tethering auxiliary craft 130 to mother ship 102 and must also be corrosion resistant. Suitable materials for cable 116 include, without limitation, corrosion-resistant stainless steel, etc. It is within the capabilities of those skilled in the art to design or specify a cable suitable for use in conjunction with the illustrative embodiment of the present invention.

As described in further detail in conjunction with FIGS. 2 and 5-7, by virtue of the structure of auxiliary-craft coupler 134, when cable 122 goes taut, coupler 134 is rotated into axial alignment with mother-ship coupler 118. Thus, in the state of system 100 depicted in FIG. 1B, mother ship 102 and auxiliary craft 130 are tethered to one another and couplers 118 and 134 are axially aligned with one another.

In FIG. 1B, mother-ship coupler 118 is not engaged to auxiliary craft connector 134; it remains near boom 124, held in place by a release cord, etc. (see, e.g., FIG. 3, tether 350).

FIG. 1C depicts system 100 after mother-ship coupler 118 and auxiliary-craft coupler 134 are mated. To attain this state from the state depicted in FIG. 1B, mother-ship coupler 118 is released from its suspended position. When released, coupler 118 slides downward along cable 122 due to gravity until it engages coupler 134.

Engaged couplers 118 and 134, in conjunction with conduits 116 and 136, form a continuous path for the flow of utilities and signals 114 from mother ship 102 to auxiliary craft 130. In the illustrative embodiment, transmission is typically uni-directional from mother ship 102 to auxiliary ship 130. In some other embodiments, transmission is bi-directional. Bi-directional communication is typically for signals (e.g., electrical, optical, etc.); however, as desired, bi-directional transmission of electrical power and fluids can be established, as well.

Those skilled in the art will appreciate that, in addition to being axially aligned, couplers 118 and 134 must be rotationally aligned (to the extent that features, such as fluidic, electrical, and/or optical connectors are included in the coupler and are radially-offset from the rotational or central axis of the couplers). Alignment features for rotationally-aligning couplers 118 and 134 are disclosed later in this specification.

Figure 2:
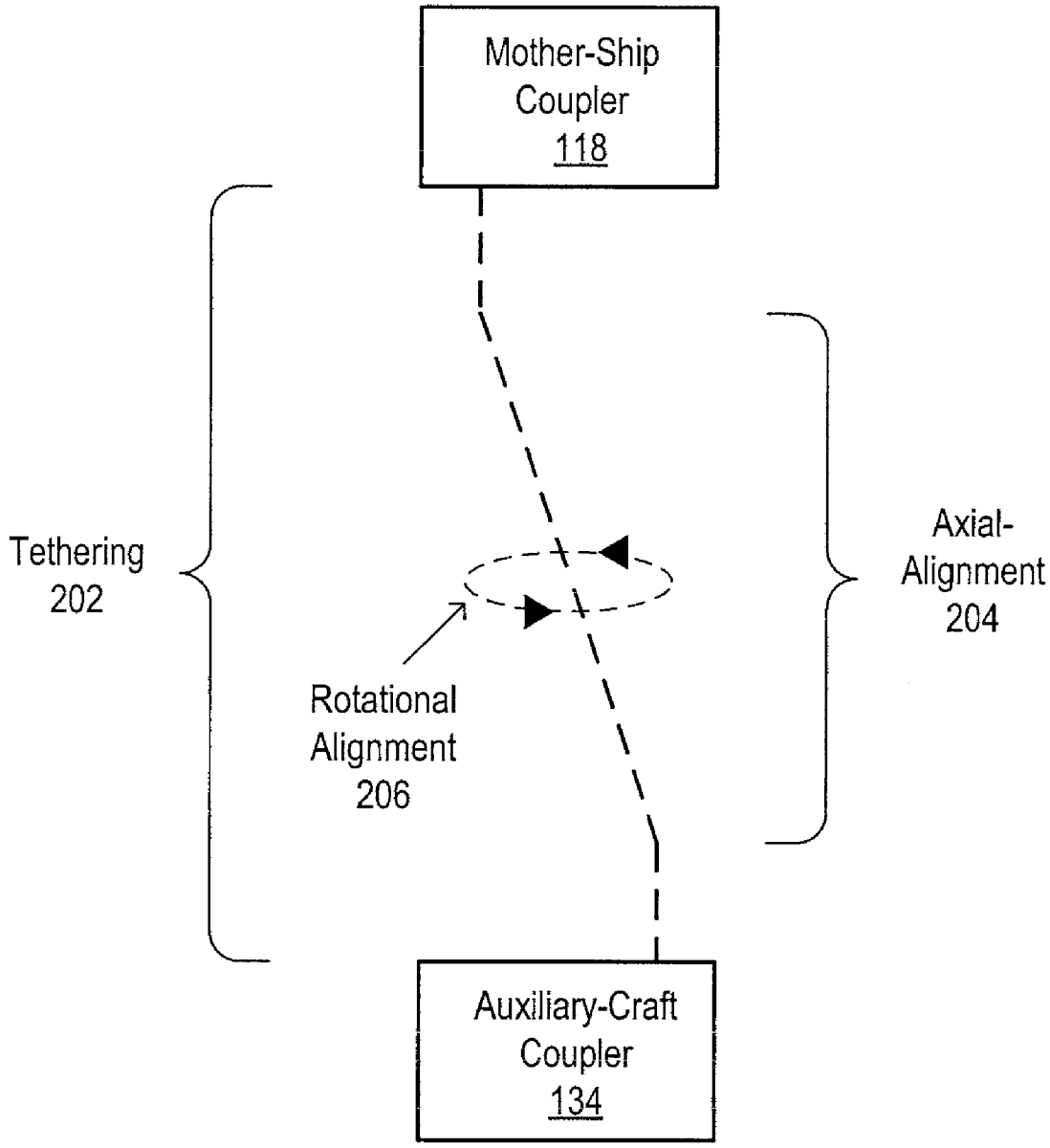
FIG. 2 is a diagram that depicts, for the illustrative embodiment, the functionality required to connect the mother ship and the auxiliary craft.

FIG. 2 provides a diagram that depicts, conceptually, certain functionality that offboard connection system 100 provides in the illustrative embodiment in order for mother-ship coupler 118 and auxiliary-craft coupler 134 to mate to one another. In particular, and as discussed above, system 100 provides tethering function 202, axial-alignment function 204, and, in some embodiments, rotational-alignment function 206.

Regarding tethering function 202, the mother ship and auxiliary craft must be kept in the vicinity of one another to join couplers 118 and 134. The tethering function is accomplished by cable 122 and fixture 132. Cable tensioner 120 also plays a role in tethering since a taut cable will keep the mother ship and auxiliary craft tethered better than a slack cable.

Couplers 118 and 134 must be axially aligned to engage one another. Drawing cable 122 taut accomplishes the axial alignment in conjunction with a structural feature of auxiliary-craft coupler 134. Both tethering 202 and axial alignment 204 are therefore accomplished, at least in part, by cable tensioner 120 and cable 122.

Mother-ship coupler 118 freely slides along cable 122 when released. Likewise, coupler 118 is free to rotate about its central axis, along which taut cable 122 aligns. As a consequence, without more, the rotational orientation of coupler 118 is indeterminate. But in order for couplers 118 and 134 to properly seat or mate, due to the presence of connectors within the couplers, the rotational orientation of the two couplers must match. In the illustrative embodiment, rotational-alignment functionality 206 is provided by certain features of couplers 118 and 134, as described in conjunction with FIGS. 9A, 9*b*, and 10-12. In some other embodiments, rotational alignment can be achieved via trial and error (repeated coupling attempts).

This specification now proceeds with further details of the structure and operation of offboard connection system 100.

FIG. 3 depicts further detail of cable tensioner 120. In the illustrative embodiment, the cable tensioner is realized as constant-tension winch 340. The winch, which is typically powered electrically or hydro-electrically, is mounted on deck 303 of mother ship 102 near to inboard end 346 of boom 124. Constant tension winches are well known in industry and those skilled in the art will be able to design and/or specify a winch that is suitable for use in conjunction with system 100.

First end 352 of cable 122 is coupled to constant tension winch 340. The cable passes over pulleys 342 and 344, which are mounted on boom 124. Second end 356 of cable 122 is attached to boom 124 near outboard end 348 thereof. The portion of cable 122 between pulley 344 and second end 356 hangs freely (when untensioned) forming a (catenary) loop.

Mother-ship coupler 118 is slideably engaged to cable 122 through bore 319. Leash 350 is attached to coupler 118. In the quiescent state of system 100, leash 350 supports coupler 118 against gravity near the "top" of the loop of cable, proximal to boom 124. In the illustrative embodiment, leash 350 is wrapped around a post or other fixture on mother ship 102. To mate the two couplers, leash 350 is untethered from the post, which permits mother-ship coupler 118 to drop into mating engagement with auxiliary-craft coupler 134. In some other embodiments, leash 350 is coupled to a pulley system (not shown) that operates in conjunction with constant tension winch 340. The pulley system automatically releases leash 350 when cable 122 is tensioned.

Tethering Functionality 202. FIG. 4 depicts further detail of the manner in which auxiliary craft 130 and mother ship 102 are tethered to one another. In the embodiment depicted in FIG. 4, fixture 132 includes a first vertically-disposed member 358 and a second member 360. The two members are substantially orthogonal to one another and effectively form a "hook." In the illustrative embodiment, second member is cylindrical.

To begin the tethering process, auxiliary craft 130 maneuvers forward toward the loop of cable 122. Eventually, the loop passes under second member 360. When this occurs, cable 122 is pulled taut via constant tension winch 340.

In some embodiments, member 360 is angled downward such that the angle formed between it and first vertically-disposed member 358 is less than ninety degrees. In such embodiments, member 360 is angled downward by up to about 20 degrees. This decreases the likelihood that cable 122 will disengage from the "hook" until it is intentionally released.

Figure 5:
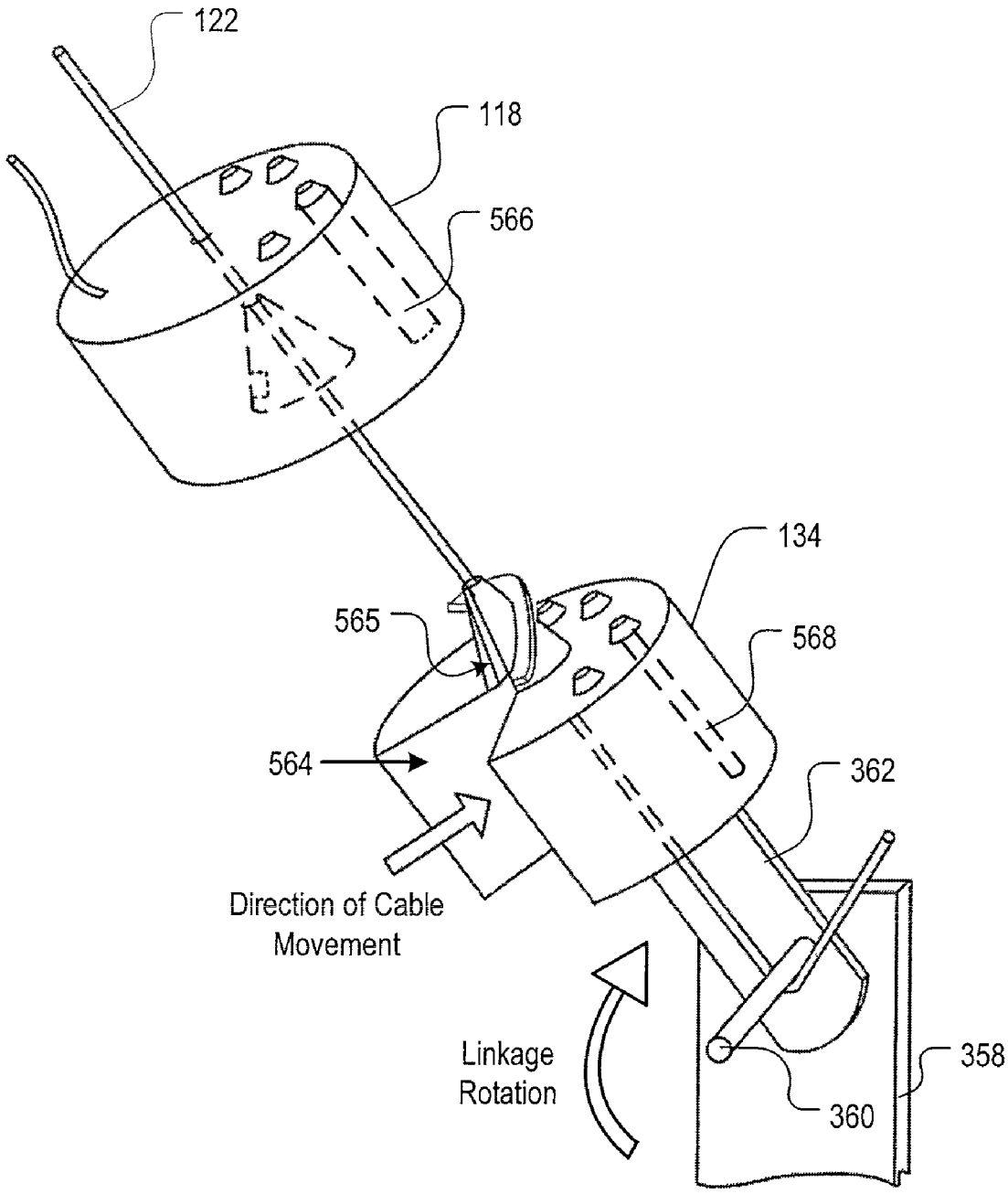
FIG. 5 depicts a perspective view of a mother-ship coupler and an auxiliary-craft coupler wherein the couplers are axially-aligned in preparation for engagement.

Axial Alignment Functionality 204. FIGS. 5 through 8 depict further details concerning axial alignment of mother-ship coupler 118 to auxiliary-craft coupler 134 prior to mating. FIG. 5 depicts these couplers axially aligned along taut cable 122 (but before the couplers engage one another).

As previously indicated, after the loop of cable 122 and the "hook" (e.g., members 360/358, etc.) engage, cable 122 is pulled taut via constant tension winch 340. As cable 122 is tensioned, it moves "upward," entering wedge-shaped aperture 564. With continued tensioning, cable 122 moves radially inward with respect to coupler 134 (as indicated by the arrow in FIG. 5) toward the central axis of that coupler. Furthermore, as cable 122 is tensioned, and due to its position within aperture 564, the cable causes linkage 362 (and attached coupler 134) to partially rotate "upward" about member 360 (as indicated by the arrow in FIG. 5).

Figure 6A:
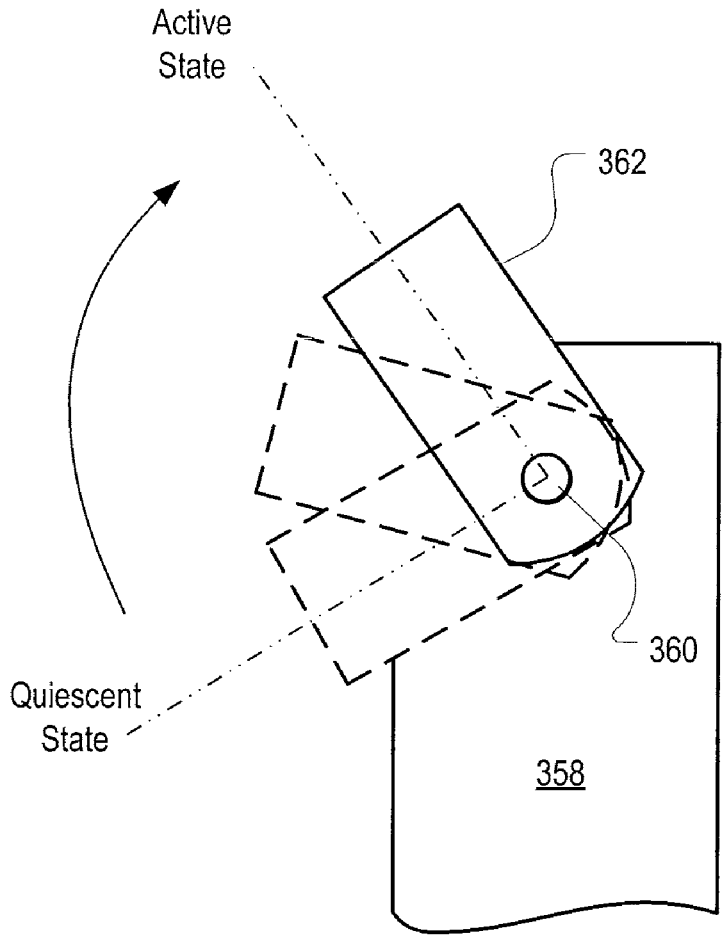
FIG. 6A depicts a linkage, which connects the auxiliary-craft coupler to the auxiliary craft, rotating the coupler into axial alignment with the mother-ship coupler when the cable is tensioned.
Figure 6B:
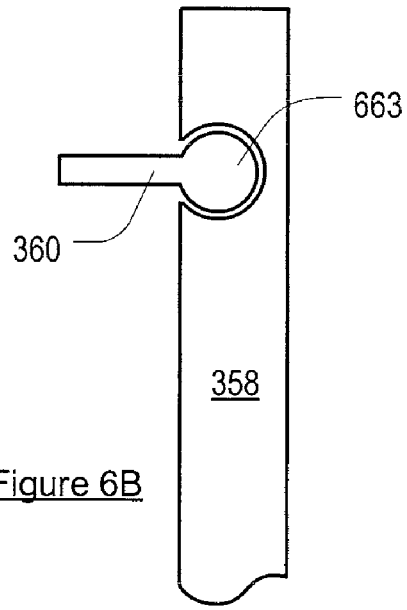
FIG. 6B depicts a first alternative embodiment for providing additional degrees of freedom of movement to the system.
Figure 6C:
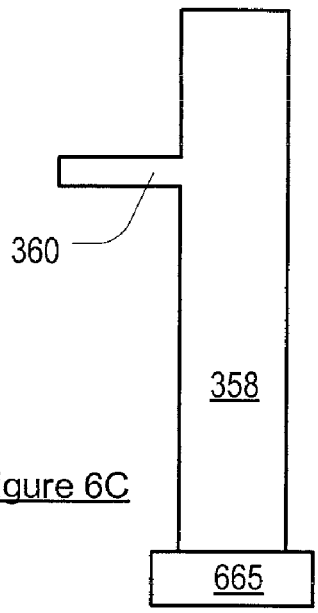
FIG. 6C depicts a second alternative embodiment for providing additional degrees of freedom of movement to the system.
Figure 7:
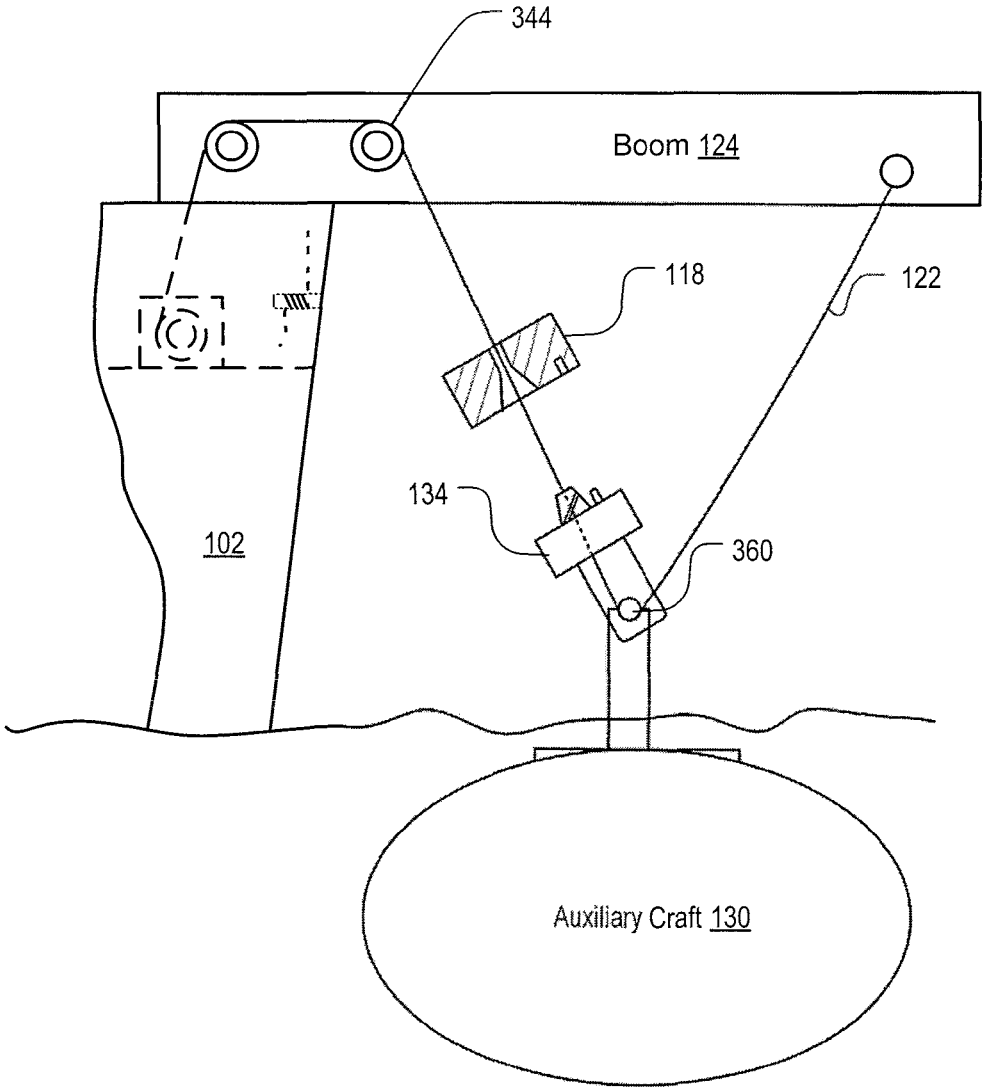
FIG. 7 depicts the cable tensioner of FIG. 3, wherein the tensioner has tensioned the cable and the couplers are in axial alignment with one another.

Rotation of linkage 362 about member 360 is further depicted in FIG. 6A, wherein the linkage rotates from a first position when system 100 is in a quiescent state (before the cable is tensioned) to a second position when the system is an active state (when the cable is tensioned). Compare, for example, FIGS. 1A and 1B. As depicted in FIG. 7, the fully tensioned cable 122 effectively demarcates a straight line between pulley 344 and member 360 along which mother-ship coupler 118 and auxiliary-craft coupler 134 align.

In some embodiments, one or more additional degrees of freedom of motion are provided to system 100 for the purpose of accommodating wave motion, etc. For example, in FIG. 6B, horizontal member 360 depends from ball joint 663. In addition to the rotational degree of freedom provided about member 360 (as per FIG. 6A), member 360 can move thereby providing additional freedom of movement. In some other embodiments, ball joint 663 can be "pinned" to limit its movement about one axis. In some further embodiments, member 360 is coupled to a gimbal mechanism, that provides rotation about two or more axes. In still further embodiments, arrangement 665 for providing one or more rotational degrees of freedom to vertically-disposed member 358 couples member 358 to auxiliary craft 130. Arrangement 665 can be, for example and without limitation, a ball joint, a pinned ball joint, a gimbal, etc.

Figure 8:
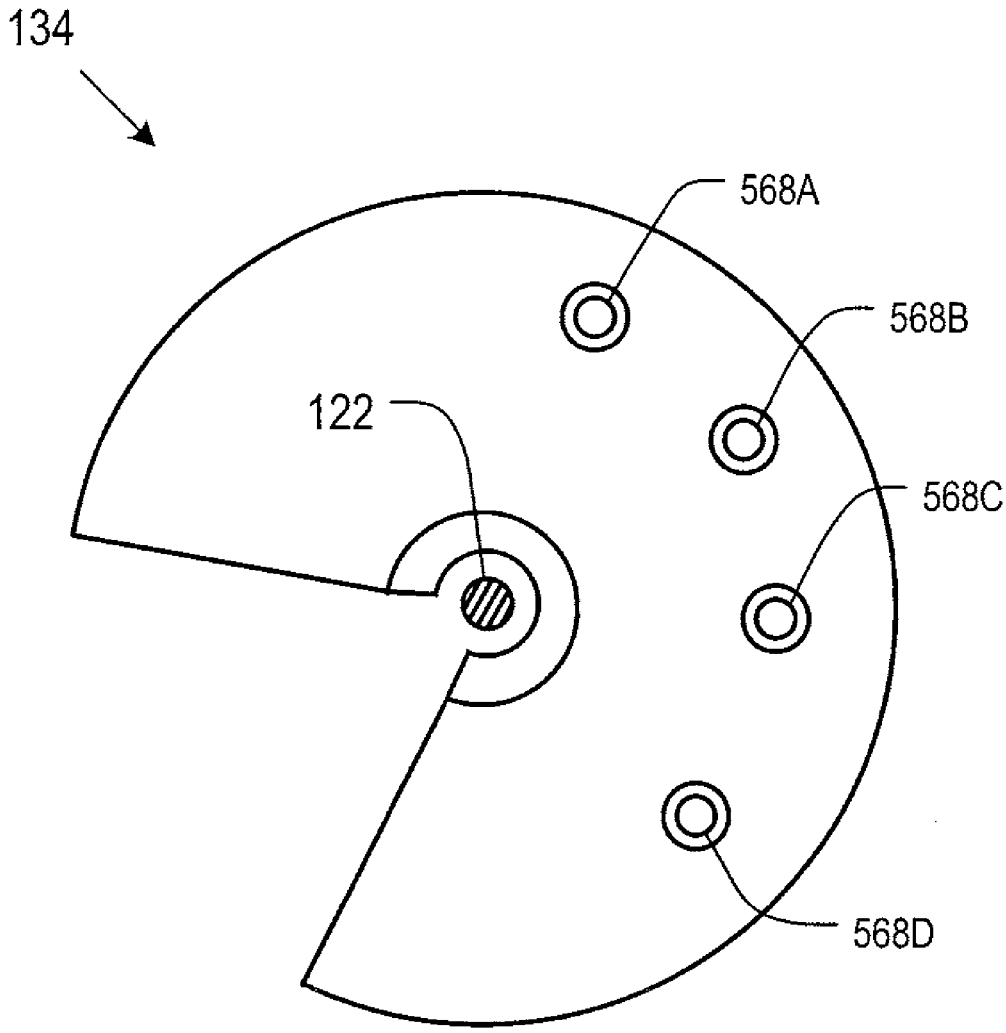
FIG. 8 depicts a simplified top view of the auxiliary-craft coupler, wherein the cable is positioned along the central axis of the coupler.

FIG. 8 depicts a top view of auxiliary-craft coupler 134 showing cable 122 aligned with the central axis of the coupler.

As previously noted, a key purpose of system 100 is to enable utilities and signals to be transferred from mother ship 102 to auxiliary craft 130. This requires that the requisite utilities and signals be conducted through couplers 118 and 134 once they are engaged. To that end, connectors are disposed within mother-ship coupler 118 and auxiliary-craft coupler 134.

Referring now to FIG. 5, and with continued reference to FIG. 8, four female connectors 566 (e.g., fluidic, electrical, optical, etc.) are disposed in mother-ship coupler 118. Four complementary male connectors 568 are disposed in auxiliary-craft coupler 134. For clarity of illustration, only one example of each connector is depicted. The connectors are appropriate for a particular service and include, without limitation, one or more of the following: fuel connectors, electrical power connectors, electrical signal connectors, optical signal connectors, and fluidic connectors. (Conduits that lead to connector halves 566 and from connector halves 568 are not depicted in FIG. 5 or 8.) The top of the four male connectors (identified as 568A through 568D) in auxiliary-craft coupler 134 are visible in FIG. 8. It is to be understood that the incorporation of four connectors is provided by way of illustration not limitation. In other embodiments, a larger or smaller number of mutually-complementary mating connectors are used.

Figure 9A:
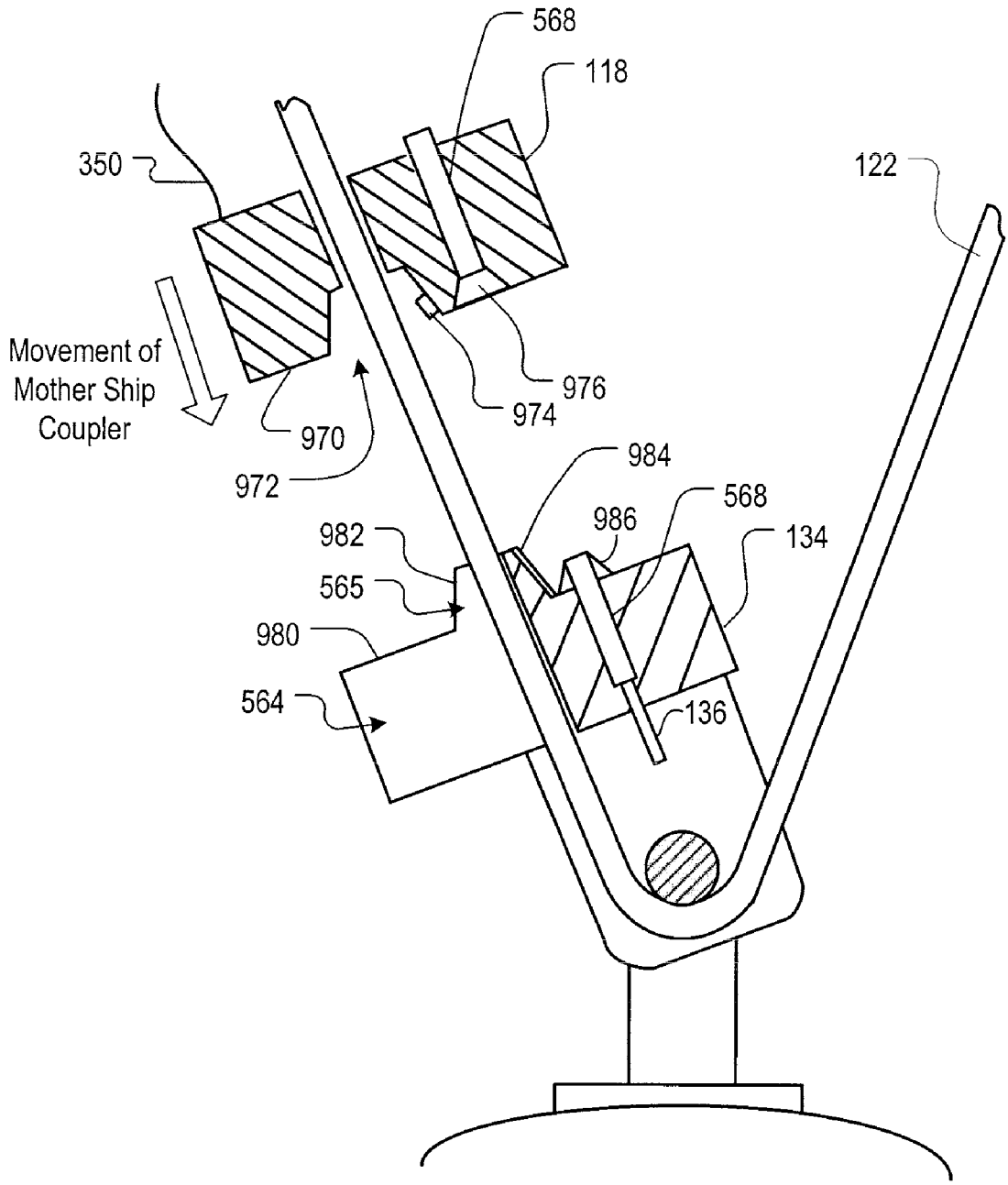
FIG. 9A depicts a fragmentary sectional view of the mother-ship coupler and the auxiliary-craft coupler, wherein the couplers are axially-aligned but not yet mated.

Rotational Alignment Functionality 206 and Connector Mating. FIGS. 9A, 9B, 10, and 11 depict details concerning the rotational alignment of mother-ship coupler 118 to auxiliary-craft coupler 134. FIG. 9A depicts the couplers axially aligned along taut cable 122 but before the couplers are engaged.

Once leash 350 is released, mother-ship coupler 118 is free to fall, under the influence of gravity, towards auxiliary-craft coupler 134. But couplers 118 and 134 must be rotationally aligned with one another to properly mate. As previously indicated, rotational alignment can be achieved by trial and error, such as via repeated drops of mother-ship coupling 118. In preferred embodiments, however, system 100 includes rotational-alignment features.

In the illustrative embodiment depicted in FIG. 9A, an arrangement for providing rotational alignment of the couplers comprises coarse rotational-alignment features and fine rotational-alignment features. These features can be used individually (i.e., either coarse features alone or fine features alone) or together. Coarse rotational-alignment features include projecting guide 982 and channel 984 on auxiliary-craft coupler 134 and complementary receiver 972 and key 974 on mother-ship coupler 118. Fine alignment features include tapered boss 986 on auxiliary-craft coupler 134 and tapered counterbore 976 on mother-ship coupler 118.

Projecting guide 982, which is mounted on upper surface 980 of the auxiliary-craft coupler, is generally conical or frusto-conical in configuration. Projecting guide 982 includes generally wedge-shaped aperture 565, best seen in FIG. 5, which communicates with and forms a continuation of aperture 564.

Receiver 972 is accessed via lower surface 970 of mother-ship coupler 118. The receiver is dimensioned and arranged to receive projecting guide 982. The projecting guide and receiver depicted in FIG. 9A are not sufficient, without more, to rotationally align couplers 118 and 134. To that end, key 974 and channel 984 are provided.

The key and channel depicted in FIG. 9A are notional. That is, they are meant to be indicative of a registration arrangement that provides rotational alignment. An actual embodiment of an arrangement for rotational alignment of the couplers is described later in this specification in conjunction with FIGS. 10 through 12.

Figure 9B:
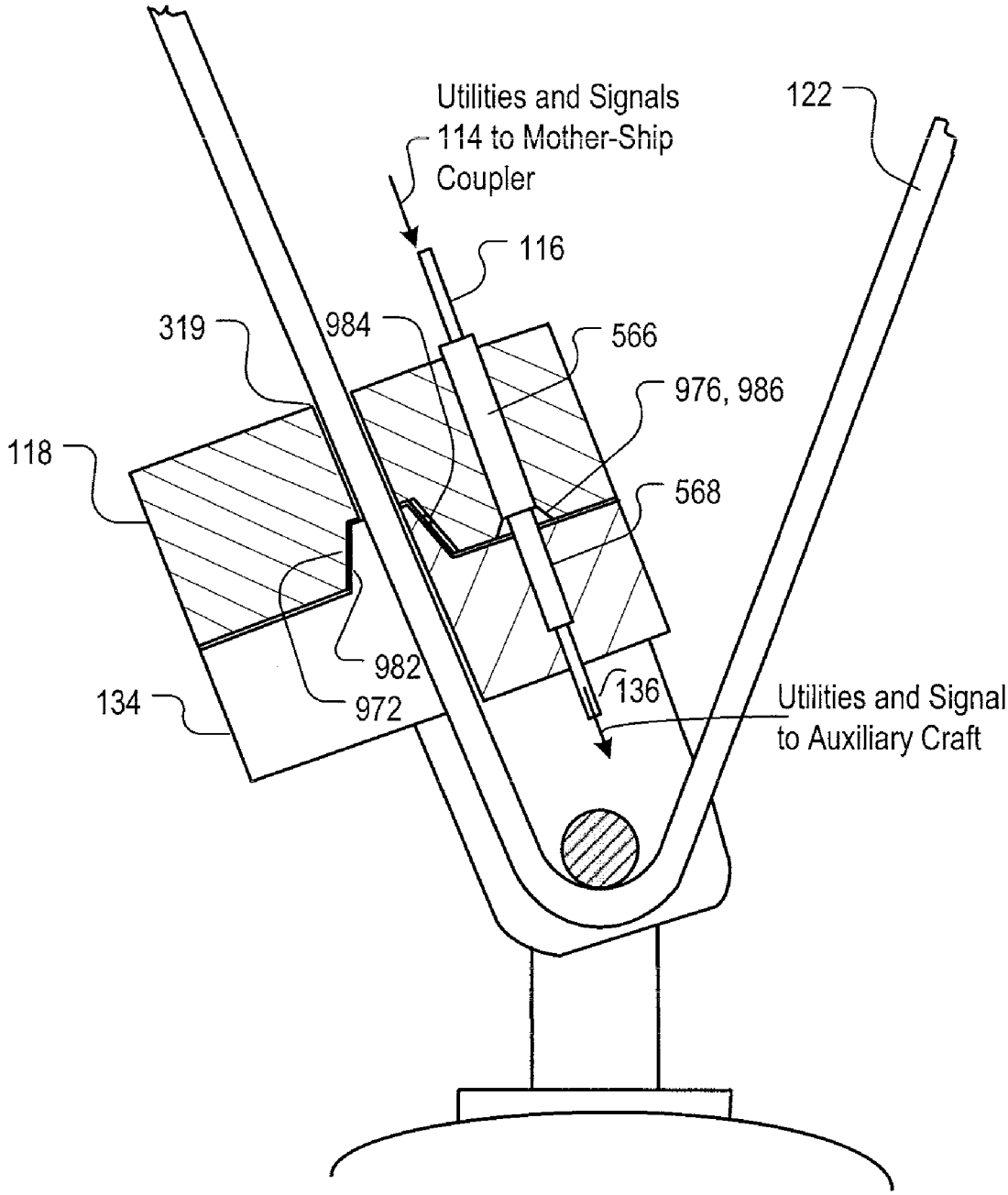
FIG. 9B depicts the couplers of FIG. 9A after they are fully mated to one another.

FIG. 9B depicts mother-ship coupler 118 and auxiliary-craft connector 134 engaged to one another. As depicted, cable 122 passes through bore 319 of the mother-ship coupler and along the central axis of the auxiliary-craft coupler. Projecting guide 982 and key 984 engage receiver 972. Male connector 568 engages female connector 566, establishing a continuous path for the transmission of utilities and signals 114, via conduits 116 and 136, to the auxiliary craft.

Figure 10:
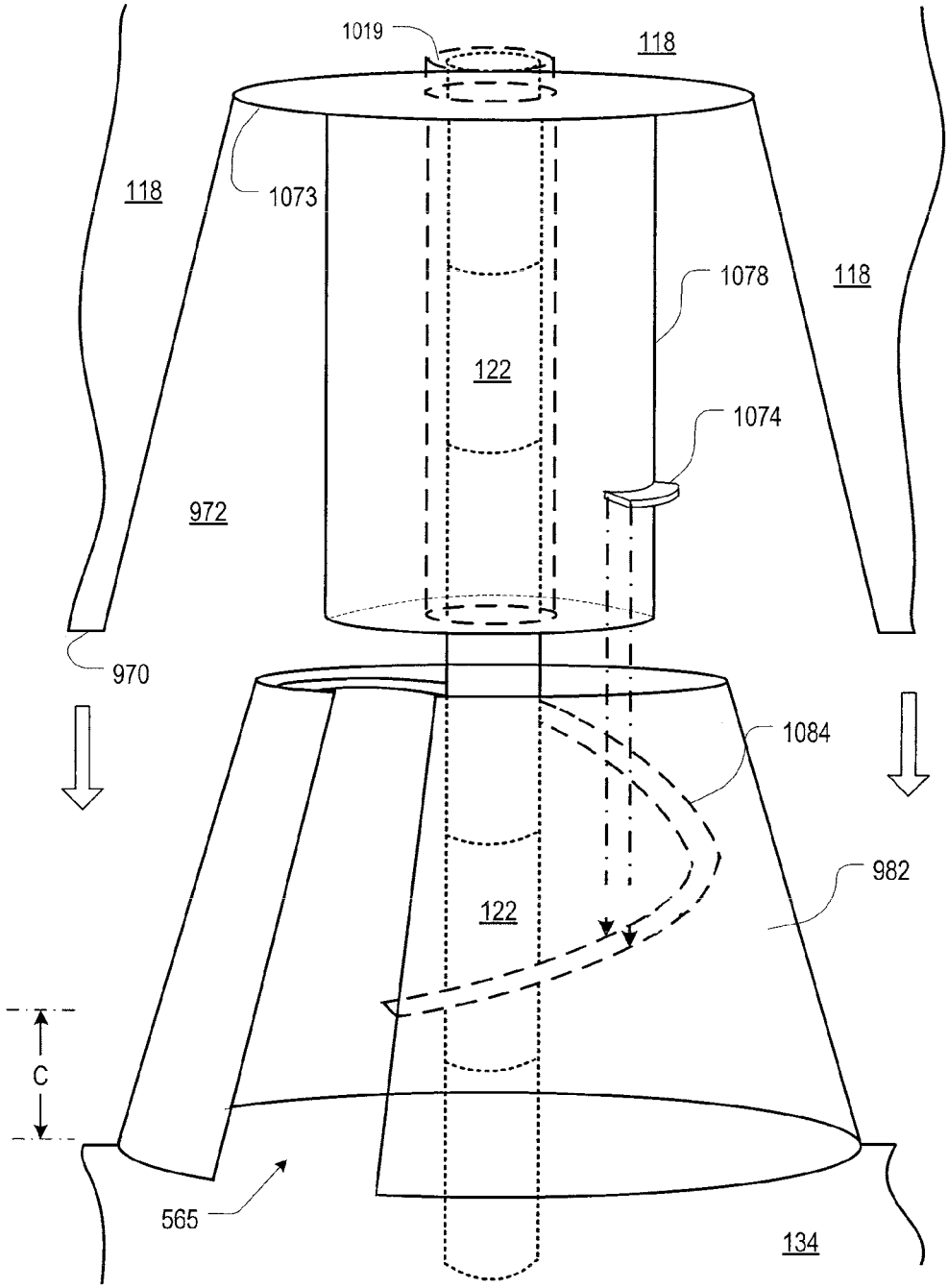
FIG. 10 depicts an embodiment of coarse rotational-alignment features for use in conjunction with the illustrative embodiment of the present invention.

FIG. 10, which shows couplers 118 and 134 nearly engaged, depicts further detail of projecting guide 982 of auxiliary-craft coupler 134 and receiver 972 of mother-ship coupler 118. In particular, FIG. 10 depicts an illustrative embodiment of the "key and channel" registration arrangement referenced earlier.

In the embodiment that is depicted in FIG. 10, mother-ship coupler 118 includes key support 1078. The key support, which extends from base 1073 of receiver 972, has a cylindrical shape. Key support 1078 is provided with bore 1019, which is a continuation of bore 319 that receives cable 122. Key 1074 is disposed on the outer surface of key support 1078.

Projecting guide 982 includes internally-disposed guideway 1084. A first end of the guideway is proximal to the apex of projecting guide 982 and a first edge of aperture 565. The second end of the guideway is disposed "below" the first end of guideway (further from the apex of projecting guide 982) and adjacent to a second edge of aperture 565. Guideway 1084 thus has a spiral configuration within projecting guide 982.

As mother-ship coupler 118 approaches auxiliary-craft coupler 134, key 1074 will ultimately pass into projecting guide 982 and will likely engage guideway 1084. Once engaged, key 1074 will slide along guideway 1084 down into projecting guide 982 as mother-ship coupler 118 continues to descend, urged by gravity. As key 1074 follows the guideway, mother-ship coupler 118 is forced to rotate about its central axis (i.e., coincident with cable 122). Eventually, key 1074 reaches aperture 565 and "falls" off of guideway 1084. In the less-likely event that key 1074 aligns with aperture 565 when the key passes into projecting guide 982, mother-ship coupler 118 will simply continue to drop, without rotation, until base 1073 of receiver 972 abuts the apex of projecting guide 982.

Key 1074 is sited on key support 1078 so that when the key enters aperture 565, mother-ship coupler 118 will be approximately rotationally aligned with auxiliary-craft coupler 134. It will be appreciated that aperture 565 must be wide enough to permit cable 122 to "enter" projecting guide 982 so that it can align with the central axis of auxiliary-craft coupler 134. As a consequence, the rotational alignment arrangement provided by receiver 972, key support 1078, key 1074, projecting guide 982, and guideway 1084 is not precise. Hence the moniker "coarse-alignment feature." In particular, the rotational alignment can be in error by a maximum amount that is approximately equal to one-half of the width $\delta$ of aperture 565.

System 100 can be implemented with only the coarse alignment features. In such embodiments, if coupler mating fails due to rotational misalignment, tether 350 (see FIG. 3) can be tensioned to retrieve mother-ship coupler 118 for another drop, etc., until proper rotational alignment is achieved.

Alternatively, to account for any rotational misalignment resulting from the width of aperture 565, fine-alignment features are provided in some embodiments. In the illustrative embodiment, the fine-alignment features comprise tapered boss 986 on auxiliary-craft coupler 134 and tapered counterbore 976 on mother-ship coupler 118. These features are depicted, for example, in FIGS. 9A and 11.

Referring again to FIG. 9A and also FIG. 11, tapered boss 986 is a generally conical or frusto-conical feature disposed on upper surface 980 of auxiliary-craft coupler 118. A tapered boss is associated with each connector 568, wherein each paired tapered boss and connector are concentrically arranged. Apex 1188 of the tapered boss has a diameter $D_{AN}$. Tapered counterbore 976 is shaped and dimensioned to be complementary to tapered boss 986 such that the counterbore receives the boss to mate associated connectors 566 and 568. Tapered counterbore 976 has a diameter $D_D$.

It was previously disclosed that the coarse-alignment feature comprising receiver 972, key support 1078, key 1074, projecting guide 982, and guideway 1084 results in a possible misalignment of about δ/2, which is one-half the width of aperture 565 of projecting guide 982. An example of such rotational misalignment is depicted in FIG. 12.

FIG. 12 depicts a simplified representation of the upper surface of auxiliary-craft coupler 134, showing tapered boss 986. The mouth of tapered counterbore 976 is projected (shown as a "dashed" line) onto the auxiliary-craft coupler. The maximum offset between the centers of the tapered boss 986 and tapered counterbore 976 is (+/−) δ/2. To ensure that tapered counterbore 976 "captures" tapered boss 986, the perimeter of the tapered counterbore must encompass the full apex 1188 of the tapered boss. This is depicted in FIG. 12. It is seen from FIG. 12 that to ensure capture of tapered boss 986, the radius $D_D/2$ of tapered counterbore 976 must be at least:

$$D_D/2=\delta/2+D_{AN}/2 \quad [1]$$

Therefore, the diameter of tapered counterbore 976 must be at least:

$$D_D=\delta+D_{AN} \quad [2]$$

As perhaps most easily visualized with reference to FIG. 5, mother-ship coupler 118 must be at least coarsely aligned with auxiliary-craft coupler 134 before lower surface 970 of the mother-ship coupler reaches apex 1188 of tapered boss 986. If coarse alignment is not achieved by this point, the fine-alignment feature cannot reliably function, since tapered boss 986 might be beyond the capture range of tapered counterbore 976.

Referring now to FIGS. 10 and 11, to ensure that coarse alignment is attained before lower surface 970 reaches apex 1188, certain structural constraints must be met. In particular, distance C between the lowest point of guideway 1084 and upper surface 980 of auxiliary-craft coupler 134 must be greater than the distance H between apex 1188 of tapered boss 986 and upper surface 980 of auxiliary-craft coupler 134:

$$C>H \quad [3]$$

In the illustrative embodiment, projecting guide 982 is disposed on auxiliary-craft coupler 134 and receiver 972 is disposed in mother-ship coupler 102. In conjunction with the present disclosure, those skilled in the art will know how to create embodiments of the invention in which the projecting guide is disposed on the mother-ship coupler and the receiver is disposed on the auxiliary-craft coupler, etc.

After receiving fuel, etc., via system 100, auxiliary craft 130 can disengage from mother ship 102 to continue its mission. To disengage mother-ship coupling 118 and auxiliary-craft coupling 134, tension is applied to tether 350. The tension pulls these two couplings apart. Coupling 118 is then returned to its stowed position on cable 122 proximal to boom 124 (see, FIG. 3).

To free auxiliary craft 130, cable tensioner 120 (e.g., winch 340, etc.) releases the tension on cable 122. This operation can be performed either before or after couplings 118 and 134 are de-mated. Once cable 122 is slack, fixture 132 can be disengaged from the cable by appropriately maneuvering auxiliary craft 130.

Figure 13:
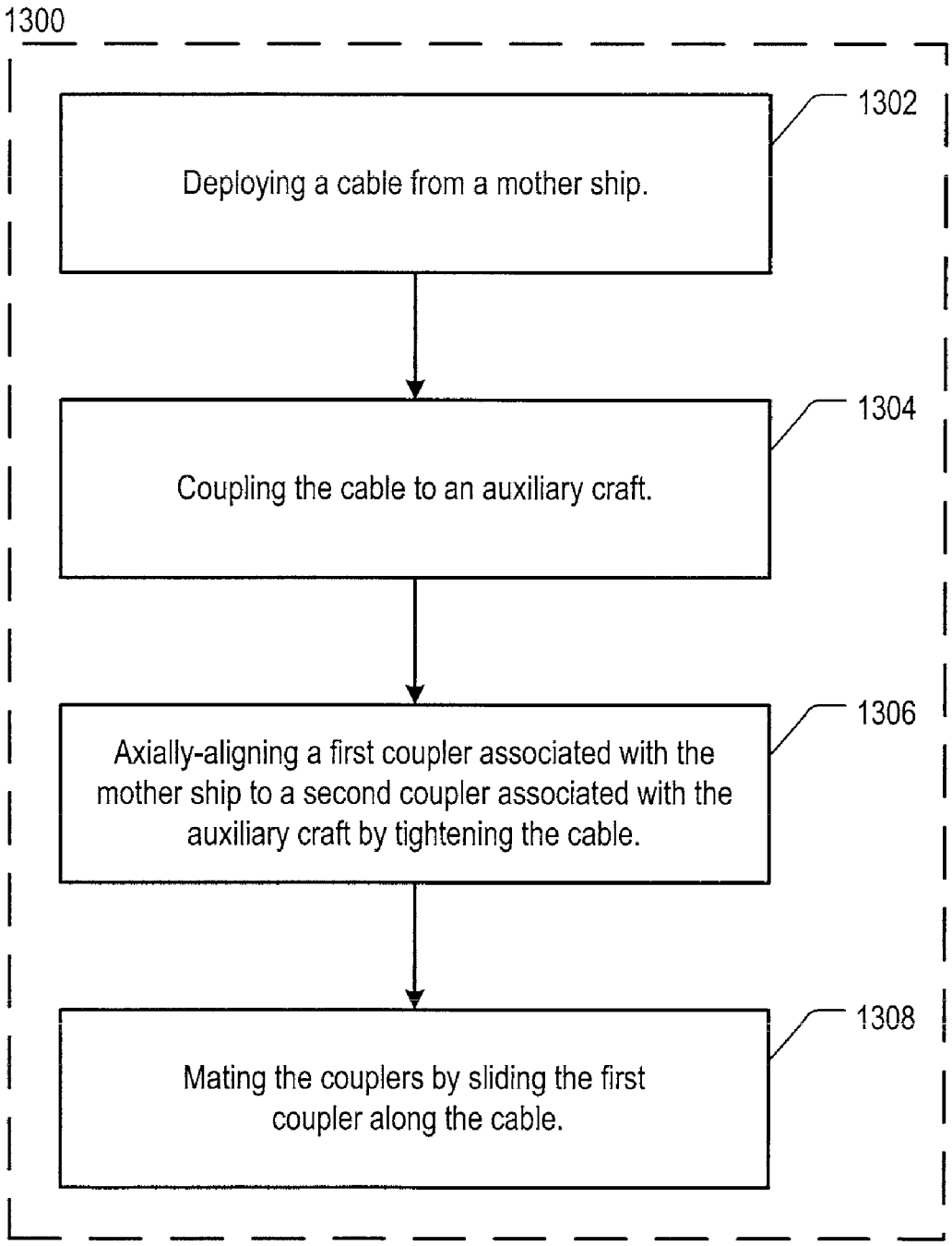
FIG. 13 is a flow diagram depicting a process in accordance with the illustrative embodiment of the present invention.

FIG. 13 depicts method 1300 for forming a connection between a mother ship and an auxiliary craft in accordance with the illustrative embodiment of the invention and includes the following operations:

- Op. 1302: deploying a cable from a mother ship;
- Op. 1304: coupling the cable to an auxiliary craft;
- Op. 1306: aligning a first coupler associated with the mother ship to a second connector associated with the auxiliary craft by tightening the cable; and
- Op. 1308: mating the couplers by sliding the first connector along the cable.

In the illustrative embodiment, operation 1302 involves forming a loop with a cable, such as cable 122, wherein the lowest point of the loop is situated near the water (see, e.g., FIG. 1A).

In operation 1304, an auxiliary craft, such as auxiliary craft 130, is maneuvered to snag the cable, such as via a fixture (see, e.g., FIG. 4: fixture 132, comprising elements 358 and 360) that depends from the auxiliary craft.

Regarding operation 1306, a coupler associated with the auxiliary craft is dimensioned and arranged so that when cable is tensioned, the cable will be urged toward the central axis of that coupler. This will cause that coupler to axially align with a coupler that is associated with the mother ship, which is engaged to the cable through a centrally-disposed bore. The phrase "coupler associated with the mother ship" is used in the appended claims to mean a coupling, etc., that is deployed from the mother ship and receives wires, conduits, etc., that are capable of conducting utilities or signals (as previously defined) from the mother ship to the coupling. The coupler associated with the mother ship is "mother-ship coupler 118," referenced earlier. The phrase "coupler associated with the auxiliary craft" is used in the appended claims to mean a coupling, etc., that is attached (directly or indirectly) to the auxiliary craft and is capable of receiving the utilities and signals from the coupler associated with the mother ship. The coupler associated with the auxiliary craft is further able to deliver into the auxiliary craft the utilities and signals that it receives. This routing is effected through suitable conduits, wire, hose, etc., running from that connector to the auxiliary craft, as previously disclosed.

After the cable is made taut, the two couplers are mated by sliding the coupler that is associated with the mother ship along the cable. In the illustrative embodiment, operation 1308 is accomplished by simply releasing the coupler that is associated with the mother ship. Once released, that coupler will slide, under the influence of gravity, toward the coupler associated with the auxiliary craft. In some embodiments, operation 1308 further comprises repeated drops to mate the couplers. In some other embodiments, the couplers "automatically" mate without any manual intervention due to the presence of rotational-alignment features.

It is to be understood that the above-described embodiments are merely illustrative of the present invention and that many variations of the above-described embodiments can be devised by those skilled in the art without departing from the scope of the invention. It is therefore intended that such variations be included within the scope of the following claims and their equivalents.

What is claimed is:

1. A system comprising:

a cable that depends from a mother ship;

a cable tensioner that is operable to apply tension to the cable;

a first coupler associated with the mother ship, wherein the first coupler is slideably mounted to and freely rotates about the cable;

a fixture that depends from an auxiliary craft, wherein the fixture is suitably configured to engage the cable, thereby tethering the auxiliary craft to the mother ship;

a second coupler, wherein the second coupler is rotatably coupled to the fixture, wherein the second coupler has an aperture, and wherein, when the cable tensioner applies tension, the aperture enables the cable to move radially inward through the second coupler to be coincident with the longitudinal central axis thereof, thereby axially aligning the first coupler and the second coupler.

2. The system of claim 1 further comprising rotational alignment features that rotationally align the first coupler and the second coupler with respect to connectors that are disposed in each of the first coupler and the second coupler.

3. A method comprising:

deploying a cable from a mother ship;

coupling the cable to a fixture that depends from an auxiliary craft by positioning the auxiliary craft with respect to the deployed cable so that the fixture snags the cable;

axially aligning, by tensioning the cable, a first coupler associated with the mother ship and that freely rotates about the cable to a second coupler associated with the auxiliary craft, wherein the tensioning causes the cable to be received in an aperture that is defined in a body of a second coupler; and mating the first coupler and the second coupler by sliding the first coupler along the cable.

4. The method of claim 3 wherein, during the operation of axially aligning the first coupler to the second coupler, the cable moves radially inward through the aperture ultimately aligning with a central longitudinal axis of the second coupler.

5. The method of claim 3 wherein the operation of mating the first coupler and the second coupler further comprises rotating the first coupler with respect to the second coupler by engaging a rotational alignment feature of the first coupler with a complementary rotational alignment feature of the second coupler.

6. The method of claim 3 wherein the operation of mating the first coupler and the second coupler further comprises rotationally aligning the first coupler and the second coupler to a definable maximum allowed rotational misalignment via coarse alignment features.

7. The method of claim 6 wherein in the operation of mating the first coupler and the second coupler, the coarse-alignment features comprise:

a projecting guide, wherein the projecting guide depends from a first major surface of the second coupler; and a receiver, wherein the receiver is disposed in the first coupler and is structrually configured to receive the projecting guide of the second coupler.

8. The method of claim 7 wherein the projecting guide includes an aperture that aligns with the aperture defined in the second coupler, wherein the two apertures enable the cable to advance radially inward to a central axis of the second coupler.

9. The method of claim 7 wherein in the operation of mating the first coupler and the second coupler:

the receiver further comprises a key; and the projecting guide further comprises a guideway, wherein the key is configured to engage the guideway and wherein engagement thereof results in rotation of the first coupler.

10. The method of claim 6 wherein in the operation of mating the first coupler and the second coupler, the definable maximum allowed rotational misalignment is a function of the width of the aperture of the projecting guide.

11. The method of claim 6 wherein the operation of mating the first coupler and the second coupler further comprises fine-alignment features for rotationally aligning the first coupler and the second coupler, wherein the fine-alignment features decrease rotational misalignment allowed by the coarse alignment features sufficiently to ensure that the first coupler and the second coupler mate to one another.

12. The method of claim 11 wherein the operation of mating the first coupler and the second coupler further comprises mating a connector that is disposed in the first coupler and a connector that is disposed in the second coupler.

13. The method of claim 11 wherein in the operation of mating the first coupler and the second coupler, the fine-alignment features include:

an tapered boss that is disposed on a first major surface of the second coupler, wherein the tapered boss is axially aligned with the connector in the second coupler; and an tapered counterbore that is disposed in a first major surface of the first coupler, wherein the tapered counterbore is axially aligned with the connector in the first coupler, and wherein the tapered counterbore is structurally configured to receive the tapered boss.

14. The method of claim 3 further comprising receiving utilities and signals at the first coupler.

15. The method of claim 14 further comprising conducting the utilities and signals received at the first coupler to the auxiliary craft via the second coupler.

16. A method comprising:

deploying a cable from a mother ship;

tensioning the cable, thereby causing:

(a) the cable to be received in an aperture that is defined a body of a second coupler, which is associated with the auxiliary craft; and (b) a first coupler associated with the mother ship and slideably mounted to the cable to axially align with the second coupler; and (c) the cable to move radially inward through the aperture in the second coupler to be coincident with a longitudinal central axis of the second coupler, thereby axially aligning the first coupler and the second coupler; and mating the first coupler and the second coupler by sliding the first coupler along the cable to engage the second coupler.

17. The method of claim 16 wherein the operation of mating further comprises rotating the first coupler with respect to the second coupler by engaging a rotational alignment feature of the first coupler with a complementary rotational alignment feature of the second coupler.

* * * * *